US005312279A

United States Patent [19]

Jang

[11] Patent Number: 5,312,279

[45] Date of Patent: May 17, 1994

[54] VACUUM FLUORESCENT DISPLAY AND MANUFACTURING METHOD THEREOF

[75] Inventor: Cheol-hyeon Jang, Pusan, Rep. of Korea

[73] Assignee: Samusung Electron Devices Co., Ltd., Kyunggi-do, Rep. of Korea

[21] Appl. No.: 818,353

[22] Filed: Jan. 9, 1992

[30] Foreign Application Priority Data

Oct. 12, 1991 [KR] Rep. of Korea ..... 91-17995
Oct. 12, 1991 [KR] Rep. of Korea ..... 91-17996

[51] Int. Cl.[5] ..... H01J 9/18
[52] U.S. Cl. ..... 445/24; 445/33
[58] Field of Search ..... 445/24, 25, 29, 33; 313/497

[56] References Cited

U.S. PATENT DOCUMENTS 4,132,920 1/1979 Kobayakawa ..... 445/24 X
4,430,598 2/1984 Okada et al. ..... 313/497
4,908,548 3/1990 Mizohata et al. ..... 313/497
5,204,583 4/1993 Jeong ..... 445/33 X

*Primary Examiner*—Kenneth J. Ramsey
*Attorney, Agent, or Firm*—Leydig, Voit & Mayer

[57] ABSTRACT

A vacuum fluorescent display and a manufacturing method thereof are disclosed. The vacuum fluorescent display has a faceplate and a substrate forming a vacuum-space, segments, filaments, grids, pin leads, stands for fixing filaments and a stationary base for fixing the stands. The stationary base is a hollowed-out rectangle which includes a pair of parallel setters for welding the stands on opposing sides of the substrate and a pair of spacing strips for maintaining the interval between the setters. The base is fixed to the substrate, and then setters are separated from each other by removing the spacing strips. The ends of setters extend outwardly from the vacuum-space to serve as a conductor to the filament.

1 Claim, 3 Drawing Sheets

VACUUM FLUORESCENT DISPLAY AND MANUFACTURING METHOD THEREOF

BACKGROUND OF THE INVENTION

The present invention relates to an improved vacuum fluorescent display and a manufacturing method thereof, which enables a pattern to be arranged as desired, the vacuum state within the tube to be stable, and automation to enhance productivity.

Vacuum fluorescent displays can be classified according to the form of their connecting leads. For example, in a frame-lead type, leads are integrally formed with the frame as a single body, and in a pin-lead type, the leads are composed of a plurality of separate pins.

FIG. 1 illustrates a conventional vacuum fluorescent display of pin-lead type, partially exposed.

In the display tube, a vacuum is formed between a faceplate 1 and a substrate 2 with an interposing spacer 3. All of the functional parts of the display are provided on the substrate 2. The following components can be given as examples of the functional parts: a segment (not shown) placed on the substrate below a grid (to be described later) providing an alphanumeric pattern; a filament 5 arranged over the segment; a grid 6 positioned between the segment and filament 5 for controlling low-speed thermoelectron emission; a getter (not shown) for additional enhancement of the vacuum in the tube; and a contact spring for applying a negative potential to a transparent conductive layer 1' which is formed on the faceplate's inner surface to assist the effective concentration of electrons.

In this vacuum fluorescent display structure, the functional parts are divided into two groups, some are formed directly on the substrate while others are spaced from the first group and formed over the substrate. The latter group includes the grid 6 and filament 5. The grid 6 is installed above the substrate 2 at a predetermined height by contacts 6' at both ends thereof which are used for fixing the grid to the substrate and for electrical conduction. The filament 5 is positioned at the top portion of the functional layer by bridge-type supports 4 which are provided at both edges of the inner surface of substrate 2.

Meanwhile, in order to operate, the functional layer must be supplied with external control voltages and provided with internal electrical circuits formed on the functional layer. To accomplish this, a plurality of exposed contacts 2' along the edge of substrate 2 form signal paths. At this time, a pin-lead 8 with U-shape clamps 8' is used for convenient connecting with a driving circuit on a separate printed circuit board. Respective pin-leads 8 arranged in a row along one edge of substrate 2 are engaged with the exposed contacts 2', and are permanently fixed by a sealing material such as frit glass 7.

In FIG. 2, a conventional frame-lead type vacuum fluorescent display is illustrated, which has similar functional parts as the foregoing pin-lead type vacuum fluorescent display. In more detail, all of the functional parts are provided on a substrate 2 below a faceplate 1 which together with substrate 2, encases a vacuum space. The functional layer includes an alphanumeric segment, a filament 5 disposed above the segment, and a grid 6 positioned between the segment and filament 5 for controlling low-speed thermoelectron emission.

Here, filament 5 and grid 6 are directly connected to the inner ends of selected leads **8*b* which are bent as crank and arranged parallel with one another along one edge of the substrate, different from the fixing construction of the pin-lead type. More specifically, grid 6 is fixed overlying the inner fixed end 8*b'* of lead 8*b* bent as crank, and the filament 5 is fixed by interposing a stand 4*b* with welding stop 4*b'* by the leads 8*b* placed at both ends. On the other hand, the segment makes contact with the inner end 8*b''* of other leads 8*b* of inverted "V" shape through the corresponding signal line connector 2''**, thereby forming an electrical circuit.

According to the above-described lead characteristics, the two aforementioned conventional vacuum fluorescent displays have merits and demerits as follows.

Since the functional layer pattern is independent of the shape of the lead, the pin-lead type vacuum fluorescent display offers a wide choice in selecting patterns of the functional layer, and it's vacuum tube has low probability of leakage. However, while the assembling jigs are simple, the process for manufacturing and assembling the leads is fastidious due to using a plurality of separate pin-type leads. Furthermore, the substrate may be damaged while fixing the leads, which makes automation in manufacturing the product difficult.

As for the frame-lead type vacuum fluorescent display, the functional part placed over the substrate such as the metallic components including the grid and filament is first fixed to the frame lead, separately from the substrate, and then is fixed to the substrate. Therefore, this type of display takes very little time to manufacture, and is favorable for automation. Further, since the lead itself is used for direct electrical connection to the filament, grid, and segment, connections between circuits are very stable and accurate. However, the orientation of the grid is determined by the direction of the leads, which offers narrower choice in selecting the desired pattern. Particularly, since a predetermined width of the lead must enter the vacuum space, the seal is apt to leak. This type is also disadvantageous in that the frame lead is integrally formed with the filament contacts, grid contacts, and segment contacts, thus, the material cost is expensive. Moreover, the manufacturing process of the frame lead itself is necessarily accompanied by punching and pressing while considering the position and/or height of each component. Once manufactured, frame lead is restricted to a specific model, impeding common usage of components. During the assembling process, strict management of the size is required to secure a stable connection of each lead to the connectors as the functional part.

SUMMARY OF THE INVENTION

Accordingly, it is an object of the present invention to provide an improved vacuum fluorescent display and a manufacturing method thereof, such that the merits and demerits of the two above-described types of vacuum fluorescent displays, are mutually complementary.

It is another object of the present invention to provide an improved vacuum fluorescent display which enables most of the components to be used commonly to reduce the material cost, the productivity to be improved by low manufacturing cost and easy automation, and the reliability of the product to be enhanced.

To achieve these and other objects, there is provided a vacuum fluorescent display comprising:

a substrate with a plurality of signal lines of a predetermined pattern thereon;

a faceplate positioned opposite to the substrate with which a vacuum-space is formed;

a segment of a predetermined pattern formed on the substrate, and electrically connected to a corresponding signal line among the signal lines;

a filament placed over the segment and serving as a thermoelectron emitting source;

a grid interposed between the filament and the segment for controlling the thermoelectrons;

a pin lead for clamping onto one edge of the substrate on which a connector of the signal line is formed, so as to electrically connect to the signal line which is in turn connected to the grid and the segment, and having a pair of U-shaped grippers at its upper portion for clamping the substrate;

a pair of stands installed on both sides of the substrate at a predetermined interval for supporting both ends of the filament; and a hollowed-out rectangular stationary base for fixing the stands by including a pair of setters for welding the stands on both sides opposing each other, and a pair of spacing strips for maintaining the interval between the setters, wherein the base is fixed to the substrate, and then, the setters are separated from each other by removing the spacing strips, and at least one end of the setter outwardly extends from the vacuum-space to function as a conductor to the filament.

The method for manufacturing the vacuum fluorescent display according to the present invention having the above-described structure is performed by combining the methods for manufacturing the conventional pin-lead type and frame-lead type vacuum fluorescent displays, in which the stationary base for fixing the filament may correspond to the conventional frame lead. However, the stationary base is a substantially hollowed-out rectangle and a separately formed grid, functioning as the lead by removing an unnecessary portion of the completed vacuum fluorescent display.

A method for manufacturing a vacuum fluorescent display to achieve above-described object of the present invention comprises the steps of:

forming a signal line for connecting the grid and segment on the substrate, and arranging the connector of each signal line along one edge of the substrate;

forming the segment of a predetermined pattern, and electrically connecting the segment to corresponding signal line;

fixing the grid having fixing means on each end over the substrate on which the segment is formed, using a conductive adhesive, so that the grid is spaced from the segment by a predetermined height while being electrically connected to a corresponding signal line;

coupling a pin lead to one edge of the substrate where the connector of the signal line is provided, for electrically connecting the pin lead with the segment and grid, and completing the formation of a first functional layer on the substrate;

manufacturing a pair of stands for supporting a filament which supplies thermoelectrons at a regular interval, said pair of stands are positioned over the grid;

forming a hollowed-out rectangular stationary base composed of at least a pair of parallel setters which support the stands as a medium for fixing the stands and are long enough to extend beyond parallel sides of the substrate, and spacing strips shorter than the width between the other parallel sides of the substrate for maintaining the interval between the setters;

fixing the stands to the setters of the base;

completing a second functional layer including the filament by welding the filament to the stands;

securing the base to the substrate by fixing the second functional layer to a first functional layer of the substrate, such that the filament extends crossing the signal lines, and the spacing stripes are positioned on the outer portion of the substrate; and removing the spacing strips for allowing the setter extending outwardly from the substrate to serve as a lead for the filament, and completing the formation of both functional layers on the substrate.

BRIEF DESCRIPTION OF THE DRAWINGS

The preferred embodiment of the present invention will now be described in detail with reference to the accompanying drawings, in which.

DETAILED DESCRIPTION OF THE INVENTION

Figure 1:
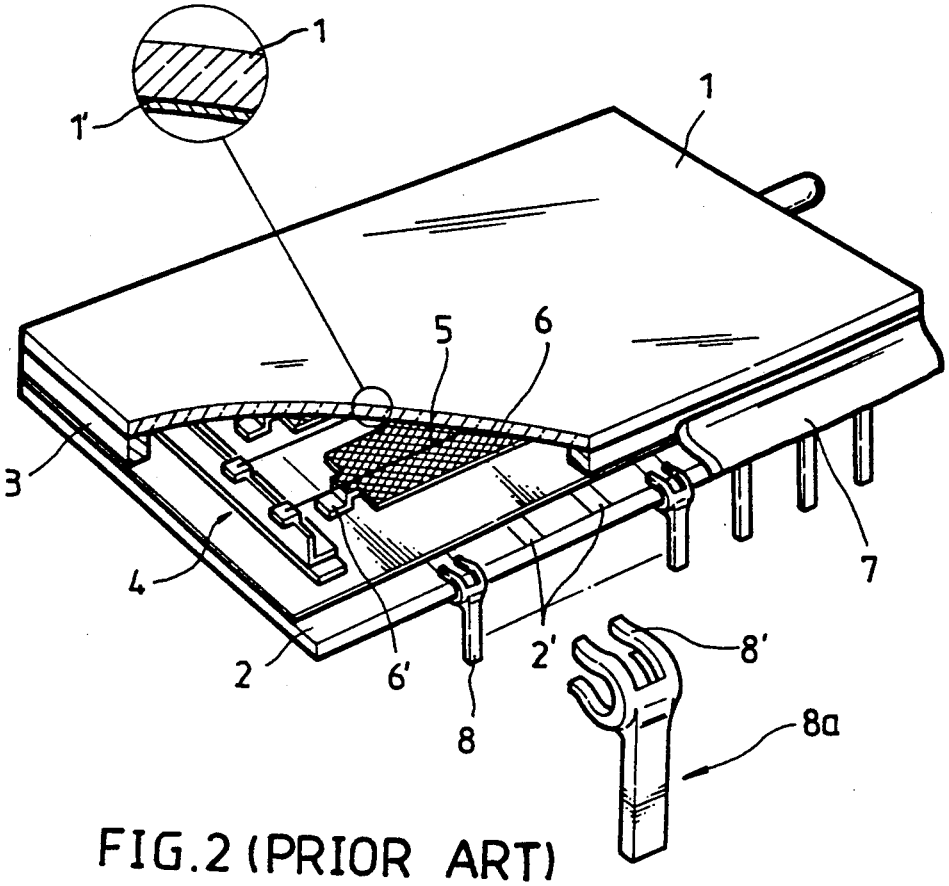
FIG.1(PRIOR ART)
FIG. 1 is a partially-exposed perspective view of a conventional pin-lead type vacuum fluorescent display.
Figure 2:
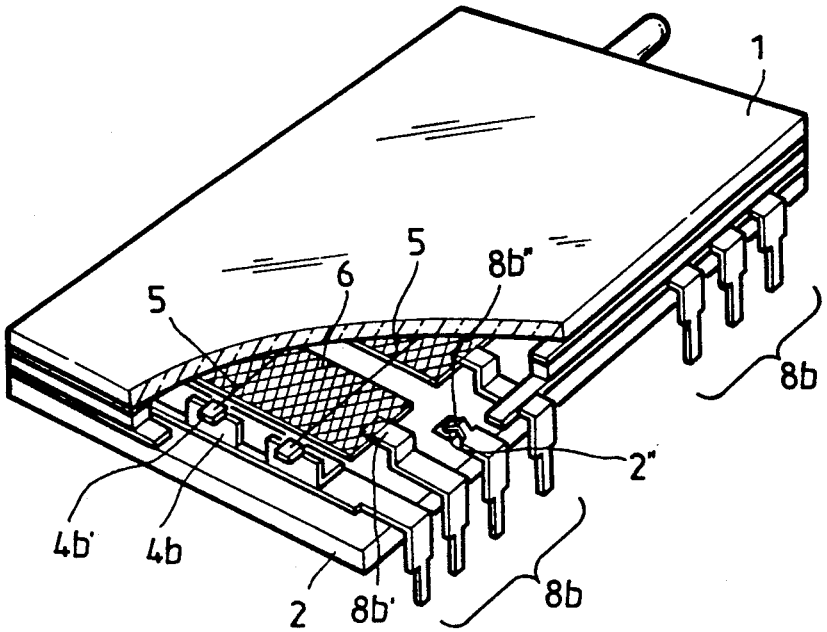
FIG.2 (PRIOR ART)
FIG. 2 is a partially-exposed perspective view of a conventional frame-lead type vacuum fluorescent display.
Figure 3A:
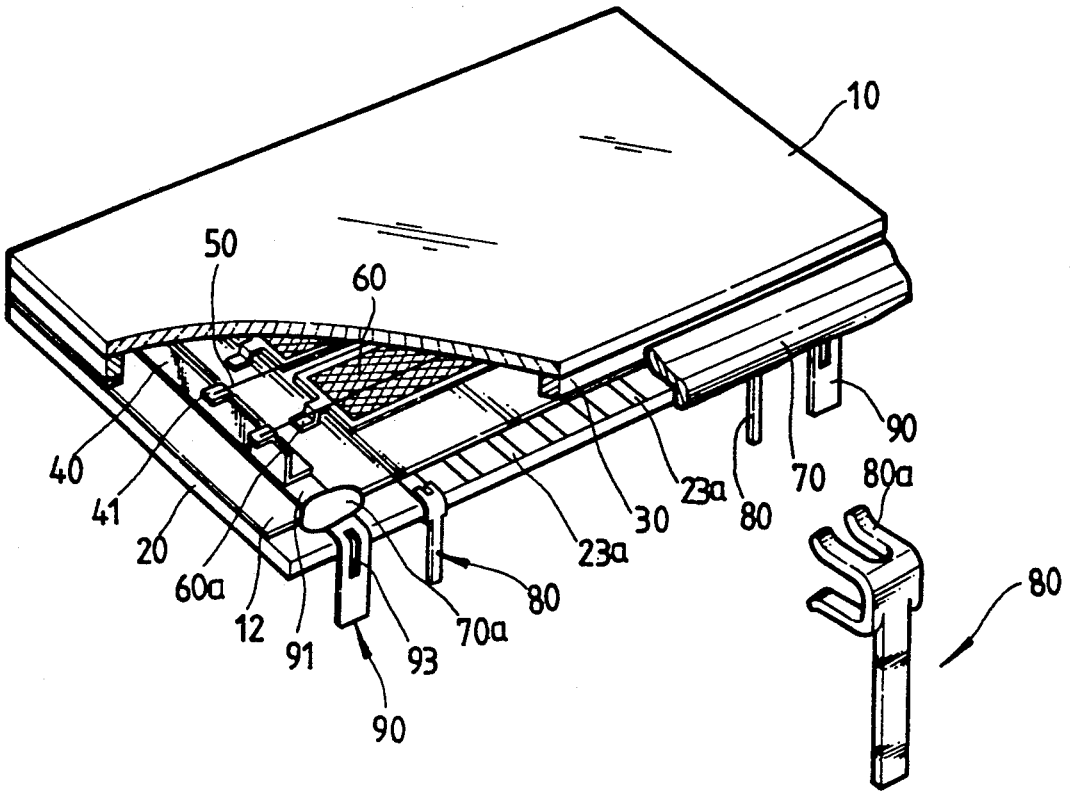
FIG. 3A is a partially-exposed perspective view of a vacuum fluorescent display according to the present invention.
Figure 3B:
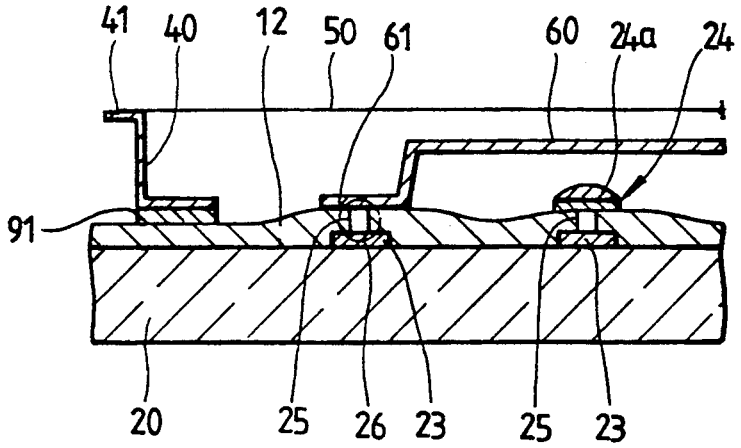
FIG. 3B is a cross sectional view of a vacuum fluorescent display according to the present invention.

A vacuum fluorescent display according to the present invention is illustrated in FIGS. 3A and 3B. A vacuum space is formed between a faceplate 10 and a substrate 20 by interposing a spacer 30, and all functional parts are provided internally on substrate 20. Signal line connectors **23*a* which are electrically connected to the internal functional parts are provided along one exposed edge of the substrate, protruding from the vacuum-space. The functional parts include: an anode segment 24 capable of forming alphanumeric patterns coated with a low-speed electron activated fluorescent; a filament 50 positioned over the segment for supplying the thermoelectrons; and a grid 60 placed between the segment 24 and filament 50 for controlling the low-speed thermoelectrons from the filament 50**.

The grid 60 being of a same net-like shape as the conventional grid, is installed over the substrate at a predetermined height using fixed ends **60*a* on both ends thereof, in which the fixed ends allow the grid to electrically connect with a corresponding signal line 23*a* formed on the substrate 20. An insulating layer 12 is formed on the surface of substrate 20 as a protection layer for preventing the electrical short of the signal lines running beneath the insulating layer. A connecting section 26 for electrical connection is partially exposed via a through-hole 25 formed in insulating layer 12. Here, fixed end 60*a* of grid 60 overlaps the connecting section, thereby fixing the grid to the connecting section 26** by a material such as conductive paste.

Since filament 50 is positioned over grid 60, a support of a considerable height is required which includes an L-shaped stand 40 and a base 90 used for fixing the stand to substrate 20. (Here, the base is the principle element of the present invention, which will be described later.) The stand 40 having a welding stop on its top to which filaments 50 can be welded at a predetermined intervals, is indirectly fixed to substrate 20 via base 90. Since the functional layer, i.e., the segment and grid 60 formed on substrate 20 must be supplied with corresponding external signals, they are electrically connected to the outside through corresponding signal lines 23. For this purpose, the signal lines 23 are extended to connectors 23*a* tightly arranged in a row along one edge of substrate 20, and then connected to pin leads 80 with a pair of U-shaped grippers 80*a* for clamping the edge of substrate 20 where connectors 23*a* are formed. The pin leads 80 are regularly arranged along the edge of substrate 20 and permanently secured thereto by frit glass 70.

On the other hand, base 90 is used for supporting and fixing filament 50 as mentioned above, and is secured by means of the first glass 70*a* to the upper surface of the insulating layer 12 or to a portion of the substrate without a signal line. The base 90 is long enough to extend beyond the edge of substrate 20. A slot 93 is formed in the extending portion so that the protrusion of base 90 can be easily bent.

Figure 4:
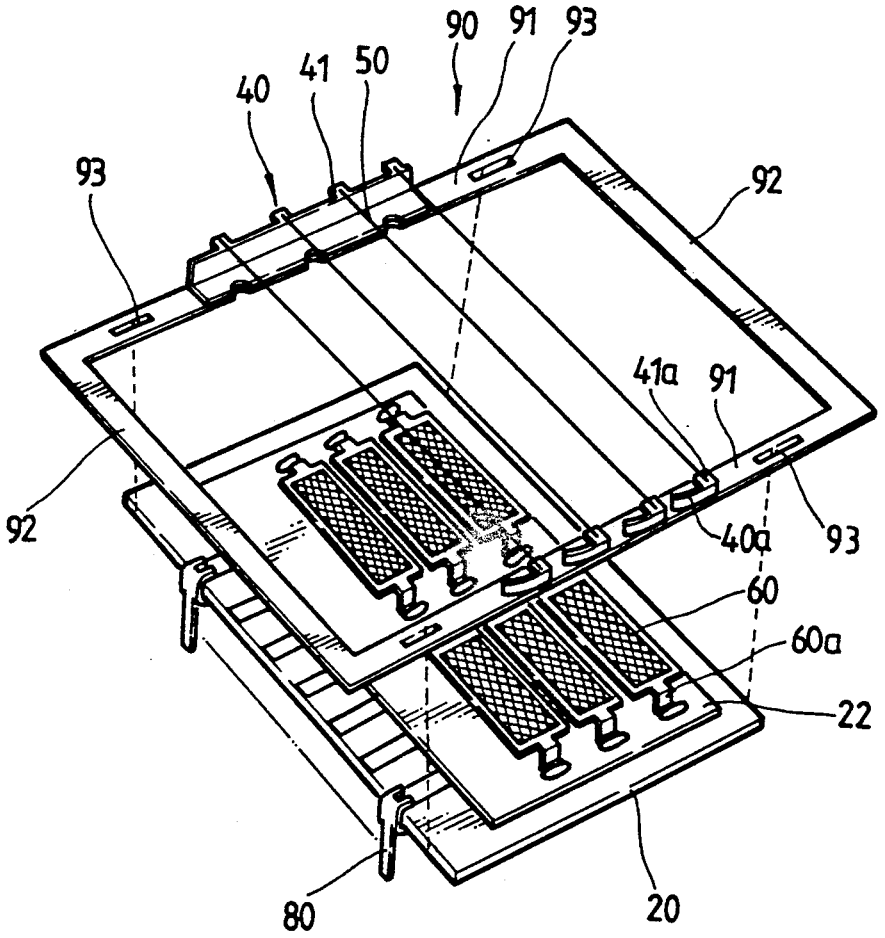
FIG. 4 is an exploded perspective view of parts of a vacuum fluorescent display for illustrating the method for manufacturing a vacuum fluorescent display of the present invention.

As illustrated in FIG. 4, the base 90 is a hollowed-out rectangle before completion, and includes a pair of parallel setters 91 facing each other on which stands 40 and 40*a* are welded, and a pair of spacing strips 92 functioning as a spacer designating the relative position of both setters 91. In a base having the above-described structure, stands 40 and 40*a* are welded, and in turn filament 60 is welded to welding stop 41 and 41*a* of stands 40 and 40*a* before being fixed to the substrate, nearly completing the base as one display tube component.

To fix the semi-processed base 90 to the substrate, the base 90 is seated on its predetermined position as shown in FIG. 4 and fixed by the frit glass 70*a*. Then, the setter 91 is cut into a pair of separate pieces by removing the unnecessary sections of the base, i.e., the spacing strips 92. Both ends of the setters 91 are exposed from the vacuum-space, functioning as a conductor to the filament.

The vacuum fluorescent display having the above-described structure is called a hybrid type which partially unites the structures of the pin-lead type fluorescent display and the frame-lead type fluorescent display. Here, the base for fixing the filament corresponds to the frame lead.

A method for manufacturing the vacuum fluorescent display having the aforesaid structure is performed such that the functional layer on the substrate 20 is separated into a first functional layer and a second functional layer to be manufactured by different processes. These separately processed layers are ultimately united. This method will be described in detail below with reference to FIG. 4.

In the present invention, the segment formed on the substrate 20 and the grid 60 directly over the segment are included in the first functional layer, and the filament 50 positioned over the grid 60 and the supporting elements 60*a* thereof are included in the second functional layer.

(A) Each signal line 23 for the grid 60 and segment 24 are formed on the substrate 20. At this time, the connectors 23*a* of respective signal lines 23 are arranged along the edge of the substrate. The processing is performed by common metal sputtering and photolithography methods.

(B) The insulating layer 12 is formed over the signal lines 23 at the desired position. Then, exposed portion of the signal line 23 allow for connection to the segment 24 and the supporting element 60*a* of the grid via the through-hole 25.

(C) The segment 24 of a predetermined pattern with a fluorescent layer 24*a* thereon is formed over the insulating layer 12 to electrically connect to a corresponding signal line 23 via the through hole 25. A silk screen printing method is used here.

(D) Using a conductive material, the grid 60 provided with the supporting elements 60*a* at both ends thereof is fixed over the substrate 20 having the segment 24 formed thereon, which allow the grid 60 to stand off from the segment while being electrically connected to a corresponding signal line 23. The net-like structure of the grid is formed by a photolithography method, and the outer structure is completed by molding.

(E) The pin lead 80 is coupled to the connector 23*a* of the signal line 23 provided along one edge of the substrate 20, so that the pin lead 80, the segment 24, and the grid 60 are electrically connected through corresponding signal lines 23, completing the formation of the first functional layer on the substrate.

(F) A pair of stands 40 are manufactured by pressing, which support the filament 50 used for supplying thermoelectrons. The stands 40 are positioned over the grid 60 to be equally spaced apart from each other.

(G) The stationary base 90 is manufactured by pressing, which is a substantially hollow rectangle and is medium to fix the stands 40 to the substrate 20. The base includes two parallel setters 91 for supporting the stands, and is long enough to extend beyond parallel sides of the substrate 20, and a pair of spacing strips 92 shorter than the width between the other parallel sides of the substrate to maintain the interval between the setters at both ends of the setters.

(H) The stands 40 are welded to the setters 91 of the stationary base, so that the setters maintain a predetermined distance between stands.

(I) The filament 50 is welded to the setters 91 of the base 90, thereby completing the formation of the second functional layer.

(J) The second functional layer is fixed over the substrate on which the first functional layer is provided, such that the filaments 50 extend crossing the connectors 23, and the base 90 is fixed by way of frit glass 70 so as for the spacing strip 92 to be positioned beyond the edges of the substrate.

(K) The spacing strips 92 placed beyond the edge of the substrate is removed using a cutting apparatus, so that the setters 91 extending beyond the substrate serve as the filament leads.

By the above-described steps, both functional layers for the substrate are completed, and if necessary, further components besides the aforesaid functional parts are additionally formed. Then, manufacture of the product is completed by fixing the spacer and faceplate.

The method for manufacturing the vacuum fluorescent display according to the present invention as above is performed by combining the methods for manufacturing conventional pin-lead type and frame-lead type vacuum fluorescent displays, in which the stationary base 90 for fixing the filament 50 corresponds to the conventional frame lead. However, the stationary base 90 is a substantially hollow rectangle and separately formed grid 60, functioning as a lead in the completed vacuum fluorescent display by removing an unnecessary extending portion.

The method for manufacturing the vacuum fluorescent display according to the present invention has advantages as follows.

First, as the conventional frame-lead type, the pattern's disposition or configuration of each functional layer of the present invention is not determined by the shape of the leads.

Additionally, the number of leads entering the vacuum-space is few to lower the possibility of leakage due to lead entry.

Moreover, the filament is welded to the separate stationary base independent of the substrate, greatly reducing the welding time.

The display is completed by forming the filament as a separate component, which makes manufacturing favorable to automation.

Further, the structure of the base 90 for supporting the filament is simple, so that the cost for the component is lower than that of a frame-lead type display.

Also, in this structure, whole parts are independently formed, enabling common usage of components.

What is claimed is:

1. A method for manufacturing a vacuum fluorescent display comprising the steps of:

forming a plurality of signal lines on a substrate;

arranging a connector for each signal line along one edge of said substrate;

forming a segment in a predetermined pattern and electrically connecting said segment to a corresponding one of said plurality signal lines;

fixing a grid having fixing means on each end over said substrate on which said segment is formed, using a conductive adhesive, so that said grid is spaced from said segment by a predetermined height while being electrically connected to a corresponding one of said plurality of signal lines;

coupling a pin lead to one edge of said substrate where each of said connectors of said signal lines are provided, for electrically connecting said pin lead with said segment and grid, and completing the formation of a first functional layer on said substrate;

manufacturing a pair of stands for supporting a filament which supplies thermoelectrons at a regular interval, said pair of stands being positioned over said grid;

forming a hollowed-out rectangular stationary base composed of at least a pair of parallel setters which support said stands as a medium for fixing said stands and are long enough to extend beyond sides of said substrate, and spacing strips shorter than said width between the other sides of said substrate for maintaining the interval between said setters;

fixing said stands to said setters of said base;

completing a second functional layer including said filament by welding said filament to said stands;

securing said base to said substrate by fixing said second functional layer to a first functional layer of said substrate, such that said filament extends crossing said signal lines, and said spacing strips are positioned on the outer portion of said substrate; and removing said spacing strips for allowing said setters extending outwardly from said substrate to serve as a lead for said filament, and completing the formation of both functional layers on said substrate.

* * * * *